United States Patent [19]

Lüeger

[11] Patent Number: 4,584,853

[45] Date of Patent: Apr. 29, 1986

[54] TRICOT KNITTING MACHINE, PARTICULARLY GALLOON CROCHETING MACHINE

[75] Inventor: Claüs Lüeger, Gipf-Oberfrick, Switzerland

[73] Assignee: Textilma AG, Hergiswil, Switzerland

[21] Appl. No.: 744,067

[22] PCT Filed: Sep. 27, 1984

[86] PCT No.: PCT/CH84/00159

§ 371 Date: Jun. 4, 1985

§ 102(e) Date: Jun. 4, 1985

[87] PCT Pub. No.: WO85/01757

PCT Pub. Date: Apr. 25, 1985

[30] Foreign Application Priority Data

Oct. 7, 1983 [CH] Switzerland ..... 5479/83

[51] Int. Cl.[4] ..... D04B 23/00

[52] U.S. Cl. ..... 66/203; 66/207; 66/208

[58] Field of Search ..... 66/203, 207, 208, 210, 66/152, 149

[56] References Cited

U.S. PATENT DOCUMENTS

| | | | |
|---|---|---|---|
| 1,346,136 | 7/1920 | Schwab | 66/152 |
| 2,155,146 | 4/1939 | Morton et al. | 66/207 |
| 3,050,972 | 8/1962 | Noe | 66/152 |
| 3,724,241 | 4/1973 | Zwingenberger et al. | 66/208 |
| 3,760,609 | 9/1973 | Poocza | 66/152 |
| 4,145,897 | 3/1979 | Villa | 66/208 |
| 4,368,626 | 1/1983 | Menegatto | 66/203 |
| 4,448,047 | 5/1984 | Romano | 66/207 |

FOREIGN PATENT DOCUMENTS

| | | | |
|---|---|---|---|
| 1217538 | 3/1966 | Fed. Rep. of Germany | 66/203 |

*Primary Examiner*—Ronald Feldbaum

*Attorney, Agent, or Firm*—McCormick, Paulding & Huber

[57] ABSTRACT

A warp knitting machine wherein the needles are inclined downwardly at an angle α lying 20°–40°.

4 Claims, 2 Drawing Figures

FIG. 1
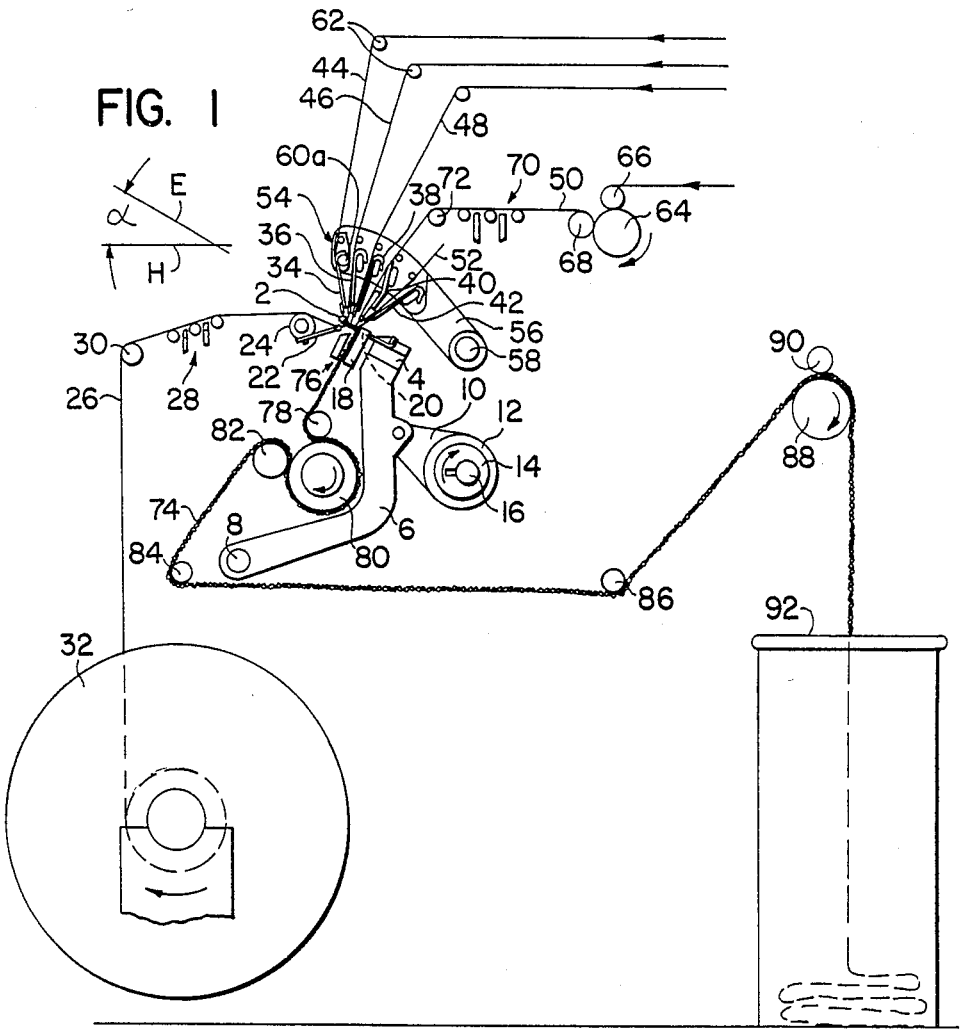
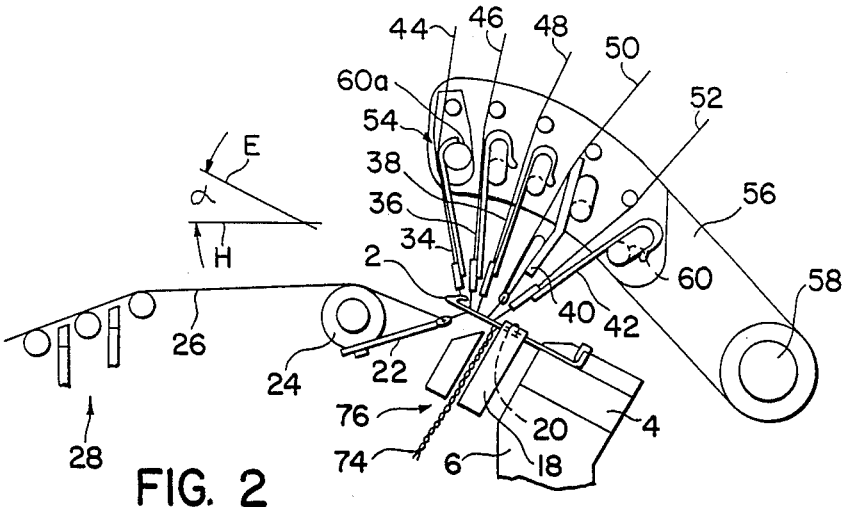
FIG. 2

TRICOT KNITTING MACHINE, PARTICULARLY GALLOON CROCHETING MACHINE

The invention resides in a knitting machine, in particular a galloon crocheting machine according to the preamble of claim 1.

Knitting machines, in particular the galloon crocheting machines of the foregoing type are well known, for example, from German Patent DE-OS No. 27 58 421. In these machines, the knitting needles and the setting needles lie practically in a horizontal plane. The knitting bars, which carry the thread guides for the weft or additional threads, lie overhead above the knitting station. This positioning impedes access to the knitting station considerably so that adjustment or monitoring of the knitting needles, the setting needles, and the thread guides is only accomplished with difficulty.

The object of the invention is to improve the knitting machines, in particular, galloon crocheting machines of the foregoing type so that the work region of the knitting needles and the setting needles as well as the thread guides is more easily accessible.

The stated object is achieved in accordance with the present invention in a surprising manner through the features defined in claim 1. By these, the plane of the knitting needles is inclined rearwardly and downwardly at an angle $\alpha$ equal to 20°–40° from the horizontal. This produces an especially favorable accessibility to the cooperative components at the knitting station, such as the knitting needles, the setting needles, the thread guides, and so forth. In this manner, during the set-up of the machine on the one hand, the correct setting of the threads is facilitated, and on the other hand, the adjustment of the cooperative elements at the knitting station as well. Beyond this, the continuous monitoring of such a knitting machine is substantially facilitated.

Advantageous detail arrangements of the knitting machine are described in claims 2–8.

The desired accessibility of the knitting needle region is further improved by the configuration according to claim 2.

It is particularly advantageous if, according to claim 3, the setting needles are arranged or positioned at the lower side of the knitting bar, and preferably run upwardly relative to the knitting needles. The warp thread then can be guided according to claim 4 whereby the handling of the warp threads and the setting needles permit their adjustment and monitoring to be further improved.

Further, it is particularly useful if the knitting machine is laid out according to claim 5, since then the portion of the pivotal arm projecting forwardly as well as the bar positioned thereon can be further reduced, which provides favorable accessibility to the knitting machine. The handling of the additional threads of which the monitoring as well as the adjustment of the corresponding thread guide is permitted through a further configuration of the knitting machine according to claim 6 is still further improved.

By means of the embodiment of the knitting machine according to claim 7, the goods produced are removed from the handling region at the work knitting station of the machine, which again provides favorable accessibility to the work region of the knitting machine. In this manner, it is of advantage if the knitting machine is further formed according to claim 8.

A preferred embodiment of the invention is described hereafter with the aid of the drawings which show as follows:

FIG. 1 illustrates a knitting machine configured as a galloon crocheting machine in a schematic illustration and in side elevation.

FIG. 2 illustrates the work region of the galloon crocheting machine of FIG. 1 at larger scale.

The galloon crocheting machine illustrated in FIGS. 1 and 2 consists of a series of knitting needles 2 at the work station. The needles are formed, for example, as hooked needles and can be assembled in various groups. The knitting needles 2 are fixed to a needle bar 4 which is located on pivot arms 6 that pivot back and forth about an axis 8. For driving the arm, there is a connecting rod 10 having a bearing ring 12 positioned on an eccentric ring 14. The eccentric ring is seated on a drive shaft 16. The knitting needles move back and forth substantially in a needle plane E which is inclined at an angle $\alpha$ to the horizontal plane H. The inclination angle $\alpha$ can range between 20°–40° and preferably is 30° as illustrated in the example. A take-up bar 18 contains channels 20 for guiding the knitting needles and for taking up the stitches formed on the needles.

A series of setting needles 22 work together with the knitting needles, and the setting needles are positioned at the underside of a setting needle bar 24. The setting needles 22 are inclined upwardly toward the knitting needles 2. The bar 24 performs an oscillating rotary movement so that the setting needles 22 are able to insert the warp threads 26 into the associated knitting needles. The warp thread 26 is actually guided at the upper side of the needle bar 24, runs over the warp thread monitoring device 28 to a stretching beam 30 at the front side of the machine and further below to a knitting beam 32.

Various thread guides, or correspondingly thread hooks 34,36,38,40,42, are positioned at the knitting station with the various additional threads 44,46,48,50,52 to be interwoven for various purposes. So, for example, the threads 44,46 can serve for inspection of the manufactured goods. The threads 48,52 as a rule serve as the weft which are guided back and forth over several knitted warps. The thread 50 can be an elastic thread which is interwoven, for example, lengthwise in the warp. The thread guides 34,36,38,40,42 are fastened to bars 54 which are guided back and forth in the lengthwise direction on pivot arms 56. A driving apparatus not illustrated in detail serves for driving the bars 54. Only one of the pivot arms 56 positioned at opposite sides of the galloon crocheting machine is shown, and this bar is rotatably journaled on the axle 58. The pivot arm 56 can be driven from the drive shaft 16 in a manner not illustrated. The pivot arm is continuously positioned backwardly and forwardly and contains various guide bearings 60 for the bars 54. In this manner, the arrangement is so affected that the frontmost guide bearing **60*a* at the elevated position of the pivot arm lies at least approximately at the highest point relative to the other guide bearing 60**.

Threads 44,46,48 rest adjacent the front side of the bar 54 and are delivered from above over a bending guide 62. The threads come from cones which are not illustrated and from other guide and monitoring devices at the back side of the crocheting machine. In a similar manner, the threads 52 can also be supplied. The thread 50 in the foregoing example is an elastic thread having a special device for transport. A transport shaft 64 serves this purpose, and the thread 50 is brought into engagement with the shaft by means of pressing shafts 66,68. The thread 50 then runs further over a monitoring device 70 to a bending guide 72, and further, to a thread guide 40.

The product strip 74 produced at the knitting station extends first into a path guide 76 which runs perpendicularly downward from the plane E of the knitting needles. A pressure shaft 78 brings the product strip 74 to a transport shaft 84 in this installation, and there the strip runs up to another pressure shaft 82 where the strip separates from the transportation shaft 80. The product strip then runs further to a bending shaft 84 positioned at the front side of the crocheting machine where the strip is guided toward the back side of the machine. After a further bending shaft 86, the product strip can either be wound on a product arbor or, as in the foregoing example, extend to a further transport shaft 88. A further pressure shaft 90 serves again to apply the necessary pressure so that a sufficient frictional engagement of the product strip is applied to the transport shaft 88. From the latter, the product strip runs by gravity into a catching container 92. One such catching container is suitable, especially for narrow product strips, such as ribbons.

Goods or several small goods, such as ribbons, going across the entire width of the machine can be manufactured in such a galloon crocheting machine.

I claim:

1. A knitting machine, in particular, a galloon crocheting machine with a series of knitting needles movable together forwardly and rearwardly by means of a rearwardly located needle bar, a corresponding series of setting needles movable in common transverse to the knitting needles, and arranged on a forwardly located needle bar whereby warp threads are guidable by the setting needles from a knitting beam at the forward side of the machine frame, and further, thread guides mounted on movable bars and arranged above the knitting needles, characterized in that the plane (E) of the knitting needles is inclined downwardly and rearwardly at an angle $\alpha$ lying 20°–40° to the horizontal (H), the setting needles (22) being mounted at the lower side of the bar (24) and extending upwardly relative to the knitting needles (2), the warp threads (26) being guided over the bar (24), and the upper side of the bar (24) lying at a higher elevation than the tip of the knitting needles (2) in a forward position, and further, the bars (54) holding the thread guides being guided at both sides of the machine frame in bearings (**60,60*a*) which are positioned on pivotal arms (56) extending rearwardly and downwardly, whereby the frontmost bearing (60*a*) of the pivot arm (56**) in its raised position of the pivot arm lies at least close to the uppermost point relative to the other bearings.

2. A knitting machine according to claim 9 characterized in that the plane (E) of the knitting needles is inclined rearwardly and downwardly at an angle $\alpha$ 30° to the horizontal (H).

3. A knitting machine according to claim 9 characterized in that the threads (44,46,48) guided by the thread guides (34,36,38) on the bars (54) are guided from above and at the forward side of the bars (54).

4. A knitting machine according to claim 9 characterized in that the knitting path (74) at the knitting station leads almost perpendicularly to the plane of the knitting needles (E) downwardly to a lower lying transport roller (80) and from there over a turning device (84,86) to the back side of the machine frame.

* * * * *